US010323898B1

(12) United States Patent
Phillips et al.

(10) Patent No.: US 10,323,898 B1
(45) Date of Patent: Jun. 18, 2019

(54) SHOOTING SUPPORT BAG

(71) Applicant: Black Branch Shooting Sports, Inc., Imperial, MO (US)

(72) Inventors: Kevan Keith Phillips, Farmington, MO (US); Michael Harlan Berger, Imperial, MO (US)

(73) Assignee: Black Branch Shooting Sports, Inc., Imperial, MO (US)

( * ) Notice: Subject to any disclaimer, the term of this patent is extended or adjusted under 35 U.S.C. 154(b) by 0 days.

(21) Appl. No.: 16/137,531

(22) Filed: Sep. 20, 2018

Related U.S. Application Data

(60) Provisional application No. 62/562,351, filed on Sep. 22, 2017.

(51) Int. Cl.
*F41A 23/04* (2006.01)

(52) U.S. Cl.
CPC ..... *F41A 23/04* (2013.01)

(58) Field of Classification Search
CPC ..... F41A 23/04; F41A 23/16; F41A 23/18; F41A 23/00; F41A 23/02; F41A 23/08; F41A 23/10; F41A 23/12; F41A 23/14
USPC ..... 42/94
See application file for complete search history.

(56) References Cited

U.S. PATENT DOCUMENTS 3,191,303 A * 6/1965 Baum ..... A61K 6/046 433/226
3,552,044 A * 1/1971 Wiele ..... A41D 31/0044 2/412
4,548,392 A * 10/1985 Rickling ..... F41A 23/00 269/156
5,332,185 A 7/1994 Walker, III
6,378,235 B1 * 4/2002 Smith ..... F41A 23/02 42/94
6,802,483 B1 * 10/2004 Leasure ..... F41B 5/14 182/187
6,891,078 B1 * 5/2005 Dillard ..... A61F 5/0118 602/20
8,683,730 B1 4/2014 Moore
9,976,693 B1 * 5/2018 Delikat ..... F16M 11/14
10,048,034 B1 * 8/2018 Reason ..... F41A 23/16
2010/0236125 A1 * 9/2010 Morrow ..... F41A 23/02 42/94
2012/0246991 A1 * 10/2012 Seuk ..... F41C 33/001 42/94

(Continued)

OTHER PUBLICATIONS

Caldwell DeadShot Boxed Combo ; https://www.amazon.com/Caldwell-DeadShot-Boxed-Combo-Front/dp/B000PW8KSM (Year: 2014).

(Continued)

*Primary Examiner* — Joshua E Freeman
(74) *Attorney, Agent, or Firm* — Brett A. Schenck

(57) ABSTRACT

A shooting support bag is provided. The shooting support baq includes first and second opposite sides. The first side has a butterfly shape and has at least one panel. The shooting support bag further includes a top portion. The top portion is positioned between the first and second sides. The top portion includes a top section and a first angled section. The first angled section extends downwardly and outwardly relative to the top section. The first angled section defines a first bearing surface area. The top portion has an exterior surface. The exterior surface comprises a non-slip surface.

17 Claims, 7 Drawing Sheets

(56) References Cited

U.S. PATENT DOCUMENTS

| | | | | |
|---|---|---|---|---|
| 2014/0110491 | A1* | 4/2014 | Roberts, Jr. | B29C 49/04 238/84 |
| 2016/0045036 | A1* | 2/2016 | Huljev | A47C 20/02 5/655 |
| 2017/0370669 | A1* | 12/2017 | Morrow | F41A 23/02 |
| 2018/0187488 | A1* | 7/2018 | Mora | E06C 7/482 |
| 2018/0187489 | A1* | 7/2018 | Parker | E06C 1/18 |

OTHER PUBLICATIONS

Gecko II, Photograph of Applicant's shooting support bag that was sold on Aug. 15, 2017.

* cited by examiner

SHOOTING SUPPORT BAG

FIELD

This application relates to a shooting bag for supporting a firearm.

BACKGROUND

Shooting support bags may be used to support firearms and stabilize the optical devices on the firearms for accurate shooting. However, the firearm may slip off the bag or may result in an unsteady shooting platform due to slippery bearing surfaces on the bag or slippery bag surfaces upon which the firearm rests. The firearm may also fall off of the bag due to the small surface area of the bag that the firearm rests upon. In addition, the shooting support bags may be filled with material such as plastic beads for flexibility, so that the bag can conform to the shape of the firearm. However, the material may not be of suitable construction to hold the shape of the bag very well. Also, long-time shooters know that ordinary plastic pellets lose shape and can compress over time, requiring the addition of more fill.

Shooting support bags may benefit from improvements.

SUMMARY

The present invention provides a solution to the above problems by providing a shooting support bag. The shooting support bag includes first and second opposite sides. The first side has a butterfly shape and has at least one panel. The shooting support bag further includes a top portion. The top portion is positioned between the first and second sides. The top portion includes a top section and a first angled section. The first angled section extends downwardly and outwardly relative to the top section. The first angled section defines a first bearing surface area. The top portion has an exterior surface. The exterior surface comprises a non-slip surface.

In another aspect of the present invention, a shooting support bag is provided. The shooting support bag includes first and second opposite sides. The first side has a butterfly shape and has at least one panel. The shooting support bag further includes a top portion. The top portion is positioned between the first and second sides. The top portion has an exterior surface. The exterior surface includes a non-slip surface. A fill material inside the bag. The fill material includes a plurality of pellets that are configured to reduce shifting of the pellets against each other and provide a gel-like soft feel to the shooting support bag.

Other aspects of the disclosed shooting support bag will become apparent from the following detailed description, the accompanying drawings and the appended claims.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 3:
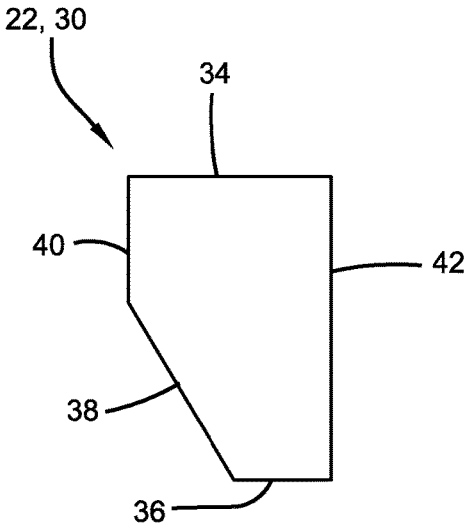
FIG. 3 is a side view of the first or fourth panel of the shooting support bag of FIG. 1.

Throughout the present description, the terms "upper", "lower", "top", "bottom", "left", "right", "front", "forward", "rear", and "rearward" shall define directions or orientations with respect to the holder as illustrated in FIG. 3. It will be understood that the spatially relative terms "upper", "lower", "top", "bottom", "left", "right", "front", "forward", "rear", and "rearward" are intended to encompass different orientations of the shooting support bag in use or operation in addition to the orientation depicted in the figures. For example, if the shooting support bag in the figures is turned over, elements described as "upper" elements or features would then be "lower" elements or features.

Figure 1:
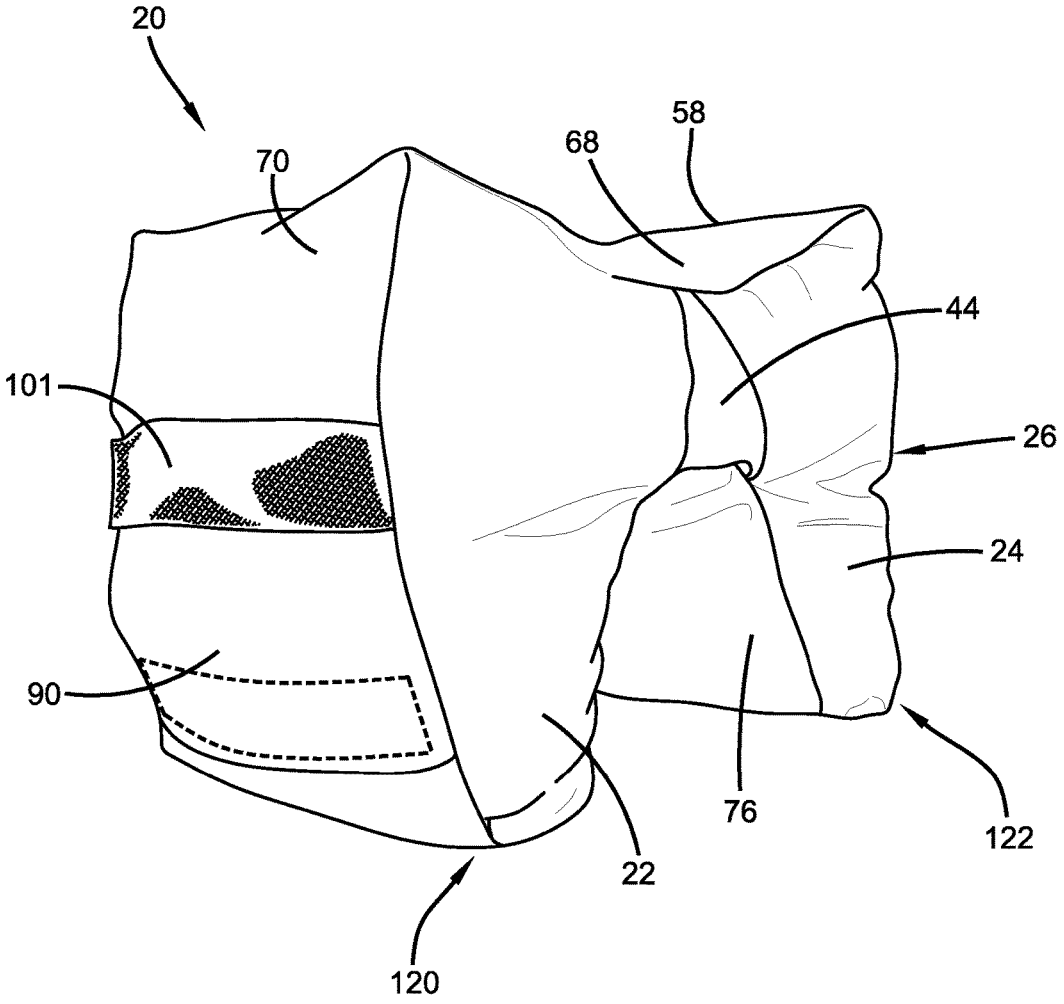
FIG. 1 is a perspective view of the shooting support bag as viewed from the first side according to an embodiment of the invention.
Figure 2:
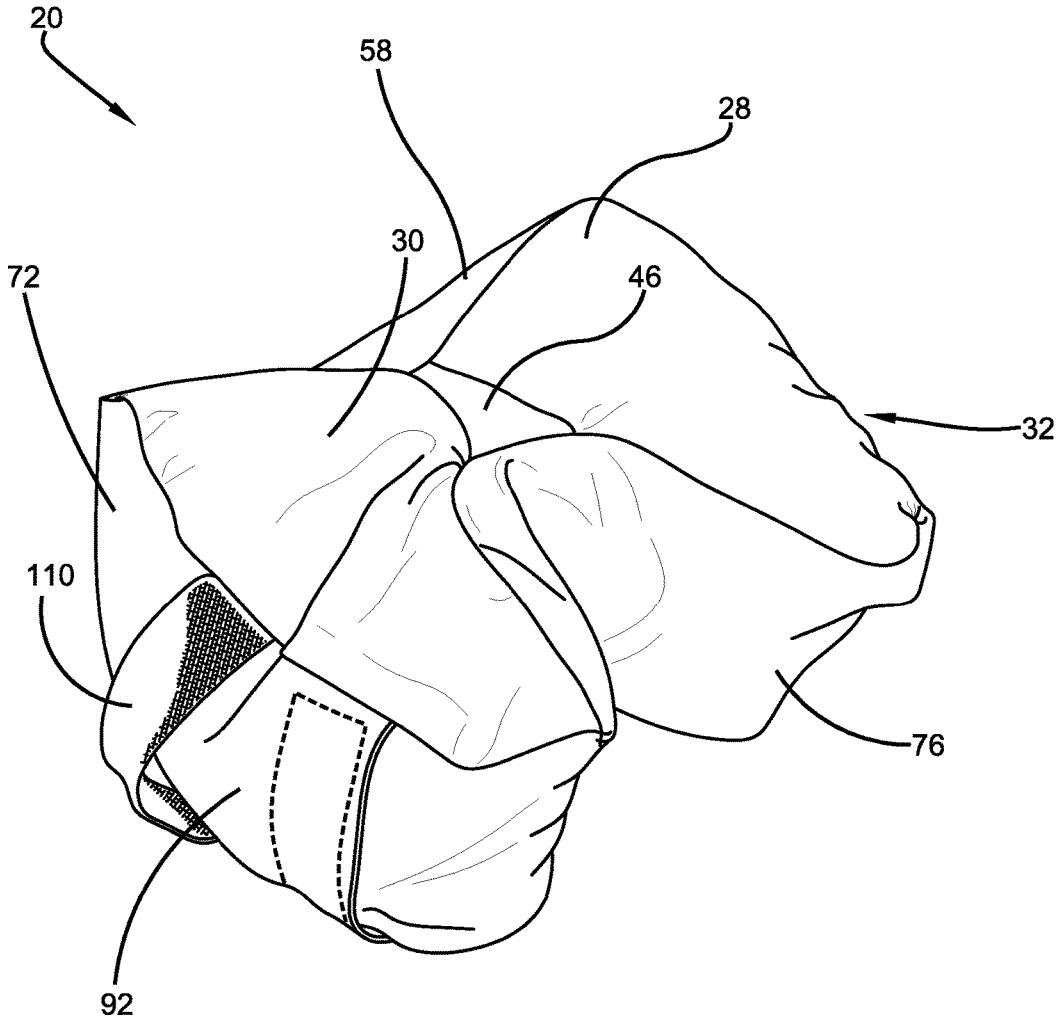
FIG. 2 is a perspective view of the shooting support bag as viewed from the second side of the shooting support bag of FIG. 1.
Figure 4:
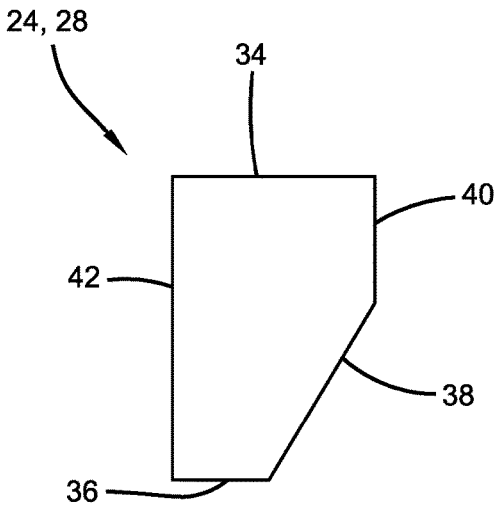
FIG. 4 is a side view of the second or third panel of the shooting support bag of FIG. 1.
Figure 5:
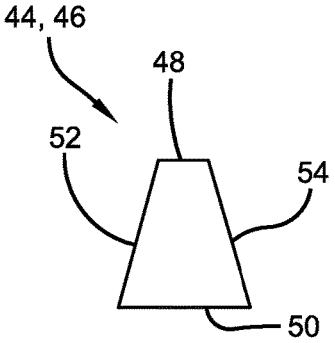
FIG. 5 is a side view of the fifth or sixth panel of the shooting support bag of FIG. 1.

Referring to FIGS. 1 and 2, the shooting support bag 20 comprises first and second fabric pieces or panels 22, 24 that are both located on a first side 26 (FIG. 1) of the shooting support bag 20. The bag 20 also comprises third and fourth fabric pieces or panels 28, 30 that are both located on a second side 32 (FIG. 2) of the bag 20 that is opposite the first side 26. As illustrated in FIGS. 3 and 4, each of the first, second, third, and fourth panels are similar in shape and generally shaped like a trapezoid and further comprise parallel top and bottom ends 34, 36, a lower outer end 38, an upper outer end 40, and an inner end 42. As seen in FIG. 5, the bag also comprises fifth and sixth generally triangular fabric pieces or center panels 44, 46 that are similar to each other and smaller than the first, second, third and fourth panels. Each of the fifth and sixth center panels 44, 46 has parallel top and bottom ends 48, 50, and first and second side ends 52, 54 that are located on opposite sides of the fifth or sixth center panel. The side ends 52, 54 converge going in the upward direction so that the top end 48 is smaller in length than the bottom end 50. The first and second panels 22, 24 are separated from each other by the fifth center panel 44. The fifth center panel 44 is located between the inner ends 42 of the first and second panels 22, 24 as seen in FIG. 1. In particular, the first side end 52 of the fifth center panel 44 is sewn or otherwise attached to the inner end 42 of the first panel 22, and the second side end 54 of the fifth center panel 44 is sewn or otherwise attached to the inner end 42 of the second panel 24. The bottom end 50 of the fifth center panel 44 and inner ends 42 of the first and second panel 22, 24 define an inverted u-shaped gap.

In a similar manner, the third and fourth panels 28, 30 are separated from each other by the sixth center panel 46. The sixth center panel 46 is located between the inner ends 42 of the third and fourth panels 28, 30 as seen in FIG. 2. In particular, the first side end 52 of the sixth center panel 46 is sewn or otherwise attached to the inner end 42 of the fourth panel 30, and the second side end 54 of the sixth panel 46 is sewn or otherwise attached to the inner end 42 of the third panel 28. The bottom end 50 of the sixth center panel 46 and inner ends 42 of the third and fourth panel 28, 30 define an inverted u-shaped gap. The fifth and sixth center panels 44, 46 may be made of a non-slip fabric material.

Figure 7:
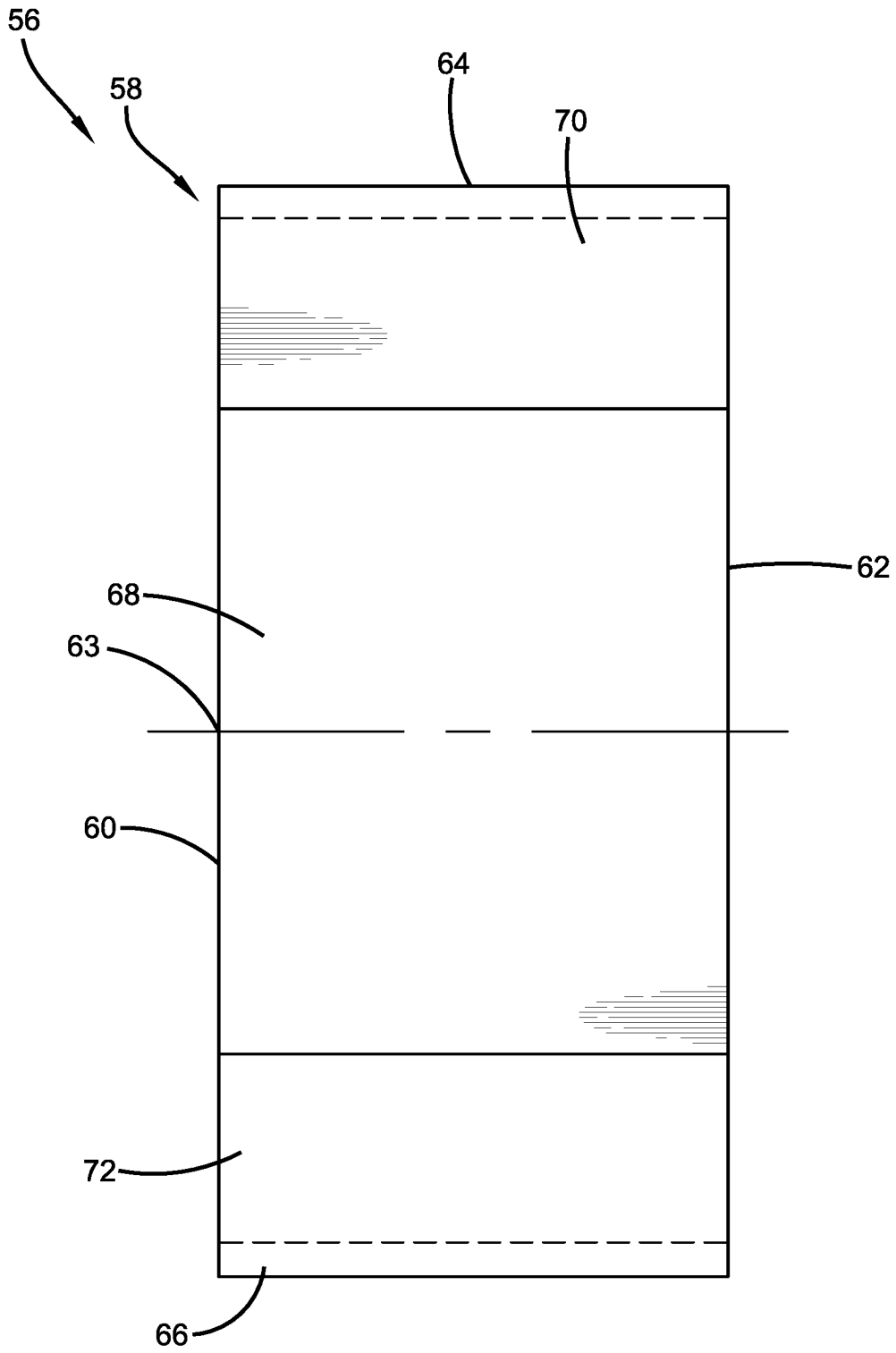
FIG. 7 is a side view of the top portion of the shooting support bag of FIG. 1.

The shooting support bag 20 may comprise a top portion 56. The top portion 56 may comprise a top fabric piece or panel 58. As illustrated in FIG. 7, the top panel 58 is generally rectangular in shape and includes opposite first and second longitudinal ends 60, 62 and opposite first and second axial ends 64, 66. The top panel 58 includes a top section 68 that is located between opposite first and second angled side sections 70, 72. The first and second angled side sections 70, 72 extend downwardly and outwardly relative to the top section 68 as seen in FIGS. 1 and 2. The portion of the first longitudinal end 60 located at the first angled side section 70 is sewn or otherwise attached to the upper outer end 40 of the first panel 22 as seen in FIG. 1. The portion of the first longitudinal end 60 located at the top section 68 is sewn or otherwise attached to the top ends 34 of the first and second panels 22, 24 and the top end 48 of the fifth center panel 44. The portion of the first longitudinal end 60 located at the second angled side section 72 is sewn or otherwise attached to the upper outer end 40 of the second panel 24.

The portion of the second longitudinal end 62 located at the first angled side section 70 is sewn or otherwise attached to the upper outer end 40 of the third panel 28 as depicted in FIG. 2. The second longitudinal end 62 located at the top section 68 is sewn or otherwise attached to the top ends 34 of the third and fourth panels 28, 30 and top end 48 of the sixth center panel 46. The portion of the second longitudinal end 62 located at the second angled side section 72 is sewn or otherwise attached to the upper outer end 40 of the fourth panel 30. In alternative embodiments, the top portion 56 may comprise multiple panels. For example, the top portion may comprise a top panel and first and second angled side panels instead of first and second angled side sections.

Figure 8:
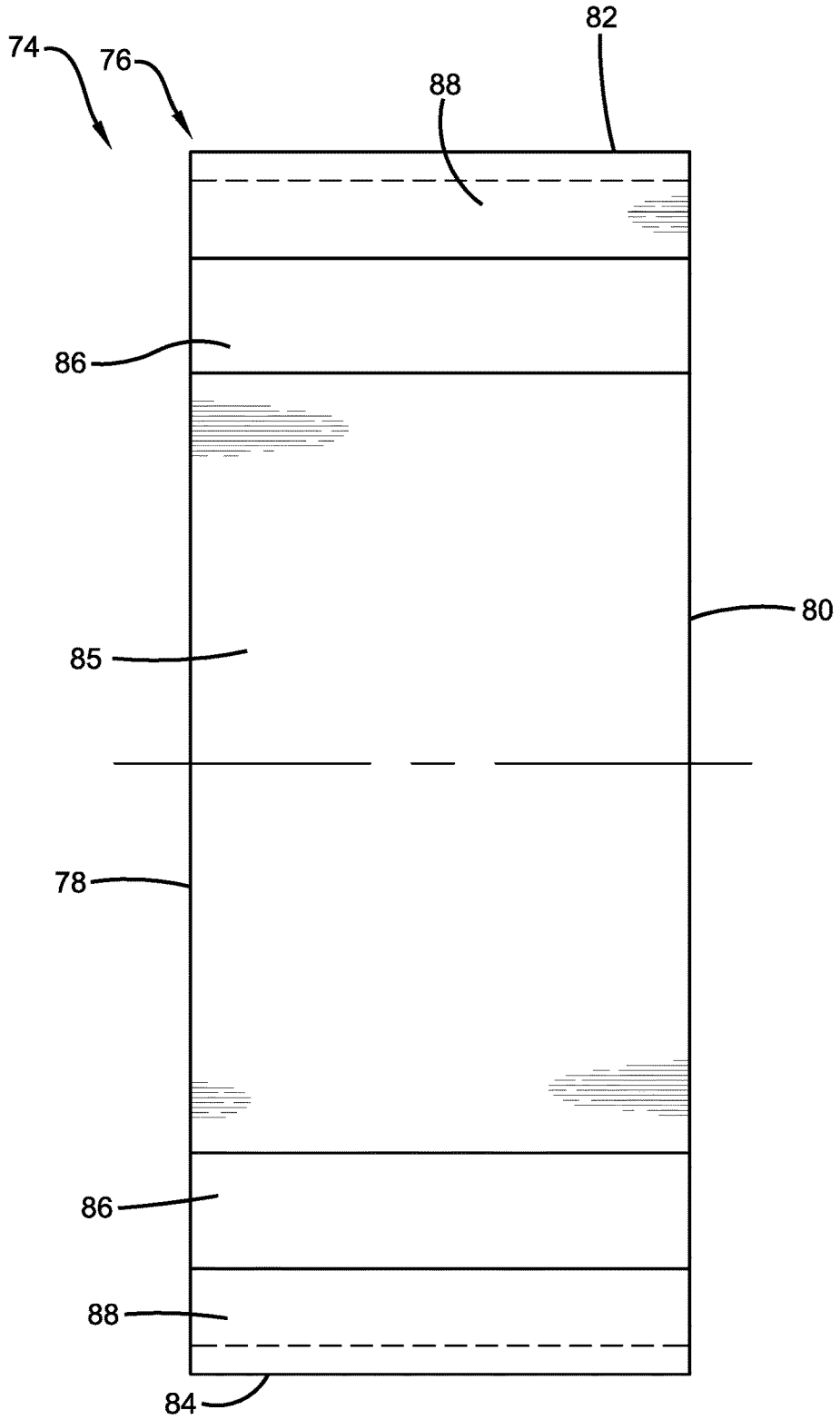
FIG. 8 is a side view of the bottom portion of the shooting support bag of FIG. 1.

The shooting support bag 20 may comprise a bottom portion 74. The bottom portion may comprise a bottom fabric piece or panel 76. As depicted in FIG. 8, the bottom panel 76 is generally rectangular in shape and includes opposite third and fourth longitudinal ends 78, 80 and opposite third and fourth axial ends 82, 84. The bottom panel 76 includes a bottom section 85 that is located between opposite inner side sections 86 and opposite outer side sections 88. As illustrated in FIGS. 1, 2, and 8, the third longitudinal end 78 is sewn or otherwise attached to the bottom end 50 of the fifth center panel 44 and the bottom, inner, and lower outer ends 36, 42, 38 of the first and second panels 22, 24. The fourth longitudinal end 80 is sewn or otherwise attached to the bottom end 50 of the sixth center panel 46 and the bottom, inner, and lower outer ends 36, 42, 38 of the third and fourth panels 28, 30. In this embodiment, the width of the top panel 58 is the same as the width of the bottom panel 76. In alternative embodiments, the width of the bottom panel may be greater than the width of the top panel. In alternative embodiments, the bottom portion may comprise multiple panels.

Figure 9:
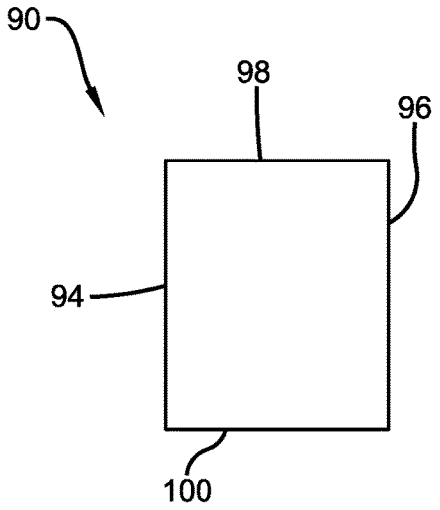
FIG. 9 is a side view of the seventh side panel of the shooting support bag of FIG. 1.

Referring to FIGS. 1, 2, 9 and 10, the shooting support bag 20 may comprises a seventh and eighth side panels 90, 92 located on opposite sides of the shooting support bag 20. As depicted in FIG. 9, the seventh side panel 90 includes first and second side ends 94, 96 and upper and lower ends 98, 100. The upper end 98 is sewn or otherwise attached to the first axial end 64 of the top panel 58. The lower end 100 is sewn or otherwise attached to the third axial end 82 of the bottom panel 76. The first side end 94 is sewn or otherwise attached to the lower outer end 38 of the first panel 22, and the second side end 96 is sewn or otherwise attached to the lower outer end 38 of the third panel 28. A fabric handle 101 is sewn or otherwise attached at its axial ends to the first and second side ends 94, 96 of the seventh side panel 90.

Figure 10:
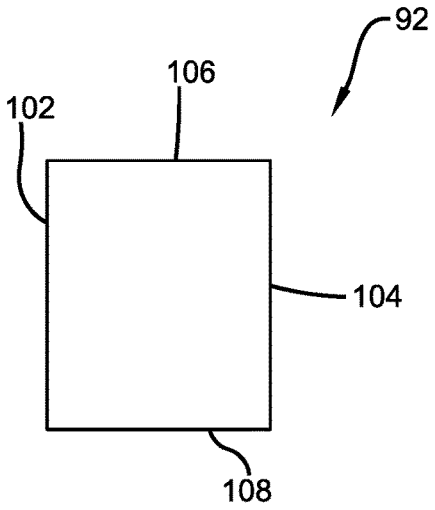
FIG. 10 is a side view of the eight side panel of the shooting support bag of FIG. 1.
Figure 11:
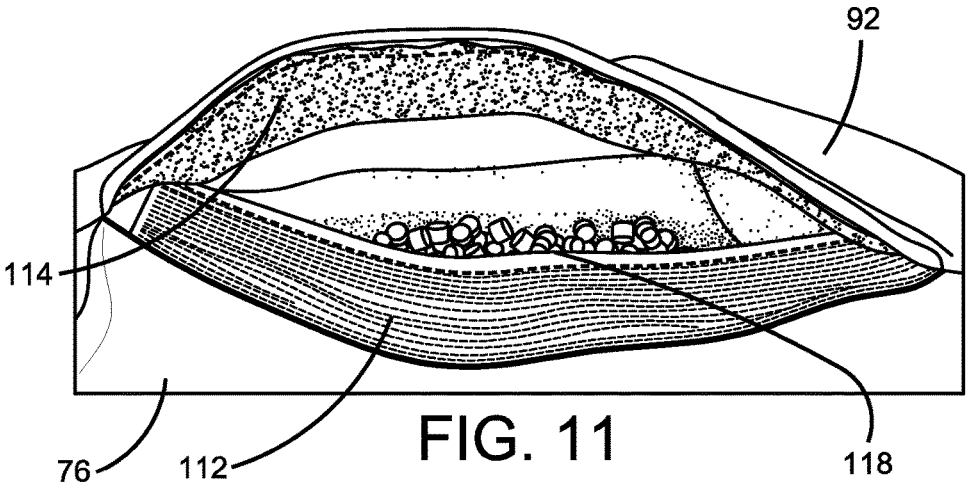
FIG. 11 is a perspective view of a portion of the support bag of FIG. 1 showing the fill port.

As illustrated in FIG. 10, the eight side panel 92 also includes first and second side ends 102, 104 and upper and lower ends 106, 108. The first side end 102 is sewn or otherwise attached to the lower outer end 38 of the second panel 24, and the second side end 102 is sewn or otherwise attached to the lower outer end 38 of the fourth panel 30. A fabric handle 110 is sewn or otherwise attached at its axial ends to the first and second side ends 102, 104 of the eighth side panel 92. The upper end 106 of the eighth side panel 92 is sewn or otherwise attached to the second axial end 66 of the top panel 58. The lower end 108 of the eighth side panel 92 detachably attaches to the fourth axial end 82 of the bottom panel 76 by a hook and pile fastener such as Velcro®. In particular, as depicted in FIG. 11, a first lineal fabric strip 112 comprising small hooks is sewn or otherwise adhered to the exterior side of bottom panel 76 at the fourth axial end 84, and a second lineal fabric strip 114 comprising smaller loops is sewn or otherwise adhered to the inner side of the eight side panel 92 at the lower end 108. When the strips 112, 114 are pressed together, the hooks catch in the loops and the eight side panel 92 and bottom panel 76 are fasten or bind temporarily together.

The strips 112, 114 are separated from each other to expose a fill port 118 for the shooting support bag 20. Fill material 119 (FIG. 6) may be poured or otherwise placed through the fill port 118 and into the shooting support bag 20 to fill the shooting support bag 20. The fill port 118 is closed when the fabric strips 112, 114 are attached to each other. FIGS. 1 and 2 show the bag in its filled state. Specifically, the bag panels are attached to each other as previously described to define a butterfly shape bag that has side by side u-shaped chambers 120, 122 that are in fluid communication with each other such that the fill material can flow between them.

Figure 12:
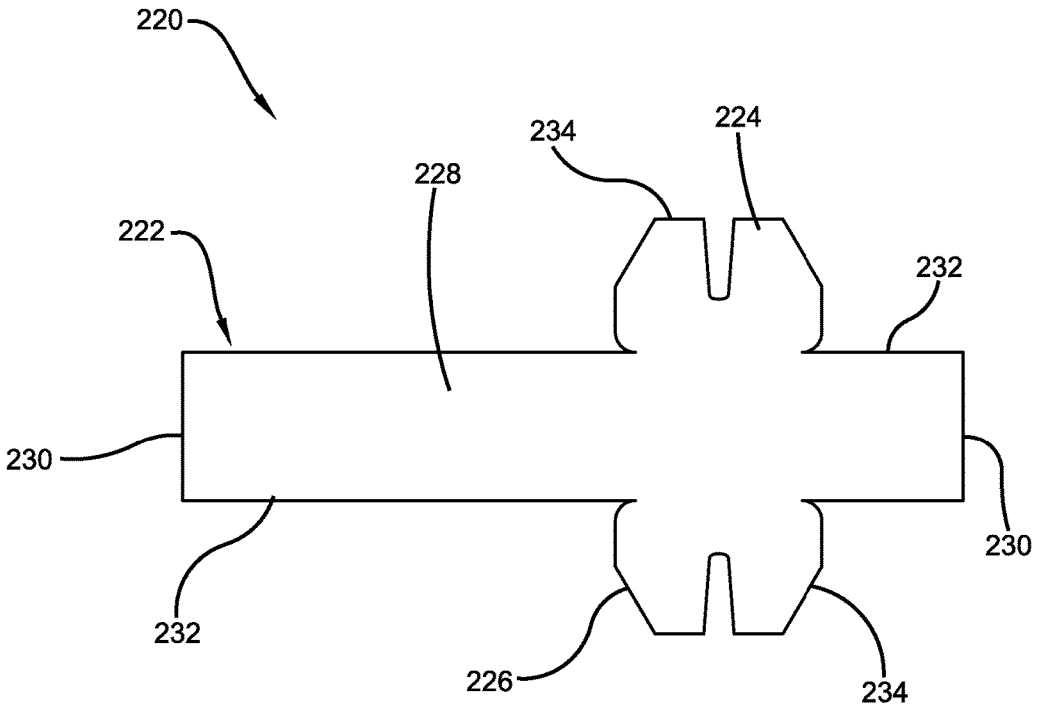
FIG. 12 is a side view of the panel of the shooting support bag according to another embodiment of the present invention.

In another embodiment as shown in FIG. 12, the shooting support bag 220 may comprise one fabric piece or panel 222. The panel 222 may comprise first and second butterfly shaped sections 224, 226 that are located on opposite sides of the shooting support bag 220. A rectangular joining section 228 is located between the first and second butterfly shaped sections 224, 226 and has axial ends 230 that are sewn or otherwise attached to each other. The longitudinal ends 232 of the joining section 228 is also sewn or otherwise attached to the peripheral ends 234 of the first and second butterfly shaped sections 224, 226 to join them together. Fabric handles may be sewn or otherwise attached at to the joining section. The shooting support bag 220 may also include the fill port that may be opened and closed by a hook and pile fastening arrangement as previously mentioned.

In one or more of the embodiments, each of the panels may be made of a pliable textile material. The top, bottom, fifth, and sixth panels comprise a non-slip material such that a firearm or other object does not slip off of the exterior surface of the panel. The non-slip material may be made of Toughtek ST-40, which is manufactured by M. Becker & Associates, Inc. and has a taper abrasion (ASTM D3884) and 2933.33 cycles average. This non-slip material may have a coefficient of friction (ATSM D1894) of 2.02 for static friction and 2.11 for kinetic friction. The non-slip material may comprise substrates. One substrate may comprise 65% Polyester and 35% Rayon, a Single Jersey, 200 G/yard. Another substrate may comprise XXH 100% Polyester, and another substrate may comprise 100% Nylon, 400 D-86 T. The non-slip material may be a rubberized material. The other panels may be made of 500 Denier Nylon having a urethane coating that is durable water repellant (DWR).

Figure 6:
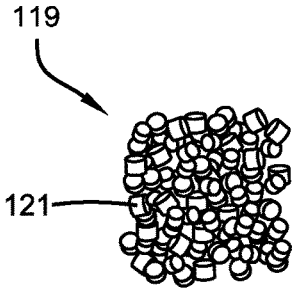
FIG. 6 is a perspective view of the pellets of the fill material of the shooting support bag FIG. 1.

As depicted in FIG. 6, the fill material 119 may comprise pellets 121 that configured to bind and lock rather than shift against each other. This provides a solid, stable shooting platform that consistently responds to the slightest squeeze. The fill material 119 may allow the shooting bag 20 to conform to both the shooting surface and whatever shape you need because of the fill technology.

One type of fill material may be composed of one of two specific grades of engineering resins mixed in a proprietary ratio with Organic Buckwheat hulls (used to lower the overall density). The fill material of these grades may have a ratio of 1 part buckwheat hulls to 7 parts Geloy XP4025 pellet by weight. The ratio may be changed to adjust to the lower density of the Starex material. The key properties of the fill material derive from the shape of the pellet to bind and lock, and also the hardness of the pellet is sufficient to prevent pellet compression and provide resilience, durability and moisture-resistance. The fill material may be of a first grade in which the specific polymer type is Polycarbonate plus Acrylonitrile Styrene Acrylate (ASA). The specific manufacturer and grade is SABIC Geloy XP 4025 black virgin pellet. The fill material having the first grade may have a density of 1.14 specific gravity, and a hardness of 114 on a Rockwell R-scale.

Alternatively, the fill material may be of a second Grade 2 in which the specific polymer type is Acrylonitrile Styrene Acrylate (ASA). The specific manufacturer and grade is LOTTE ADVANCED MATERIALS CO., LTD. Starex WR-9300-HF black virgin pellet. The fill material having the second grade may have a density of 1.07 specific gravity, and a hardness of 107 on Rockwell R-scale.

In one embodiment as shown in FIG. 6, the fill material may be composed of a custom compounded Thermoplastic Vulcanizate (TPV) pellet 121 in the thermoplastic elastomer (TPE) family. As depicted in FIGS. 6 and 11, this fill material may have irregular size and shaped pellets 121. This configuration in combination with the porosity of the pellet surface and softness (technically measured as durometer on the hardness A scale) replicate the binding and locking of the hard pellet of that of a standard fill but provide a uniquely gel-like soft feel to the bag. This fill material may have a density of 0.97 specific gravity, and a hardness of 80+/−5 Shore A.

The above-mentioned fill materials are configured to fill the bag quickly and conform to the shooting surface and the shape that a shooter needs to provide sufficient support. Because the fill material binds rather than slips, the fill material provides a solid shooting platform that consistently responds to the shooter's slightest squeeze to easily fine-tune each shot. The pellets 121 in the fill material are configured to reduce shifting of the pellets against each other The pellets of the fill material are resilient, durable, and moisture-resistant, and resistant to being compressed, because the pellets won't change shape. No additional fill may be needed, since the pellets do not compress.

This stabilizing shooting bag has panels with non-slip material on its commonly used bearing surfaces to provide a gripping action on damp or irregular/angled surfaces. The first and second angled side sections 70, 72 of the top panel 58 provide additional surface area on the bag while folded along its middle axis 63 (FIG. 7) to support a firearm during the aiming process. The portion of the bottom panel 76 located between the bottom ends 50 of the fifth and sixth center panels 44, 46 provide a non-slip bearing surface while the shooting support bag is utilized on a round narrow diameter surface. The hook and loop fastener on the shooting support bag 20 provide an easy access fill port 118 to empty or fill the shooting support bag 20 with fill material. Although various embodiments of the disclosed shooting support bag for supporting a firearm have been shown and described, modifications may occur to those skilled in the art upon reading the specification. The present application includes such modifications and is limited only by the scope of the claims.

What is claimed is:

1. A shooting support bag comprising:

first and second opposite sides, wherein the first side comprises at least one panel;

a top portion, wherein the top portion is position between the first and second sides, sides; and a fill material inside the bag, wherein the fill material includes a plurality of pellets configure to reduce shifting of the pellets against each other, wherein the pellets are thermoplastic vulcanizate pellets, wherein the pellets comprise a porous surface, wherein the pellets vary in size and shape.

2. The shooting support bag of claim 1, wherein the pellets have a density of 0.97 specific gravity and a hardness of 80+/−5 Shore A.

3. The shooting support bag of claim 1, wherein the first side has a butterfly shape.

4. The shooting support bag of claim 1, further comprising at least one fill port, wherein the fill port is opened and closed by a hook and loop fastener.

5. The shooting support bag of claim 1, wherein the first side includes first and second panels and a third panel, wherein the third panel is attached to the first and second panels and positioned between the first and second panels.

6. The shooting support bag of claim 5, wherein the second panel comprises a top end and a bottom end, wherein the bottom end is smaller than the top end.

7. The shooting support bag of claim 5, wherein the second side comprises a fourth, fifth, and sixth panels, wherein the sixth panel is positioned at the center of the second side, wherein the sixth panel is positioned between the fourth and fifth panels.

8. The shooting support bag of claim 1, wherein the first side has a butterfly shape, wherein the top portion includes a top side and a first angled side, wherein the first angled side extends between the top side and the first side, wherein the first angled side extends downwardly and outwardly relative to the top side, wherein the first angled side defines a first bearing surface area.

9. The shooting support bag of claim 8, wherein the top portion has an exterior surface, wherein the exterior surface comprises a non-slip surface, wherein the top portion includes a second angled side section, wherein the second angled side extends between the top side and the second side, wherein the second angled side section extends downwardly and outwardly relative to the top side section, wherein the second angled side section defines a second bearing surface area, wherein the first and second angled sides sections are located on an opposite sides from each other.

10. A shooting support bag comprising:

first and second opposite sides, wherein the first side comprises at least one panel;

a top portion, wherein the top portion is position between the first and second sides; and a fill material inside the bag, wherein the fill material includes a plurality of pellets that are configured to reduce shifting of the pellets against each other, wherein the fill material comprises a ratio of 1 part buckwheat hulls to 7 parts Geloy XP4025 pellet by weight.

11. The shooting support bag of claim 10, wherein the first side has a butterfly shape.

12. The shooting support bag of claim 10, further comprising at least one fill port, wherein the fill port is opened and closed by a hook and loop fastener.

13. The shooting support bag of claim 10, wherein the first side includes first and second panels and a third panel, wherein the third panel is attached to the first and second panels and positioned between the first and second panels.

14. The shooting support bag of claim 13, wherein the second panel comprises a top end and a bottom end, wherein the bottom end is smaller than the top end.

15. The shooting support bag of claim 13, wherein the second side comprises a fourth, fifth, and sixth panels, wherein the sixth panel is positioned at the center of the second side, wherein the sixth panel is positioned between the fourth and fifth panels.

16. The shooting support bag of claim 10, wherein the first side has a butterfly shape, wherein the top portion includes a top side and a first angled side, wherein the first angled side extends between the top side and the first side, wherein the first angled side extends downwardly and outwardly relative to the top side, wherein the first angled side defines a first bearing surface area.

17. The shooting support bag of claim 16, wherein the top portion has an exterior surface, wherein the exterior surface comprises a non-slip surface, wherein the top portion includes a second angled side section, wherein the second angled side extends between the top side and the second side, wherein the second angled side section extends downwardly and outwardly relative to the top side section, wherein the second angled side section defines a second bearing surface area, wherein the first and second angled sides sections are located on an opposite sides from each other.

* * * * *